US007055286B2

(12) United States Patent
Tierney

(10) Patent No.: US 7,055,286 B2
(45) Date of Patent: Jun. 6, 2006

(54) MODULAR POST SYSTEM AND METHOD OF CONSTRUCTION

(76) Inventor: Allen Richard Tierney, 22 Rees Street, Wangi Wangi, New South Wales, 2267 (AU)

( * ) Notice: Subject to any disclaimer, the term of this patent is extended or adjusted under 35 U.S.C. 154(b) by 0 days.

(21) Appl. No.: 10/214,895

(22) Filed: Aug. 7, 2002

(65) Prior Publication Data

US 2003/0029127 A1 Feb. 13, 2003

(30) Foreign Application Priority Data

Aug. 8, 2001 (AU) ..... PR6887

(51) Int. Cl.
*E04H 3/18* (2006.01)

(52) U.S. Cl. ..... 52/120; 52/166; 52/721.2; 403/286

(58) Field of Classification Search ..... 52/721.2, 52/721.3, 604, 501, 282.1, 250, 781.5, 166, 52/120, 726.3, 731.4, 731.8, 736.1; 405/286, 405/284, 285; 256/24, 73, 65.14, 68, 65.01, 256/65.02, 65.12; 446/85; 403/286, 292, 403/293, 381

See application file for complete search history.

(56) References Cited

U.S. PATENT DOCUMENTS 565,322 A * 8/1896 Dye ..... 256/50
792,342 A * 6/1905 Nesselroad ..... 52/234
1,071,985 A * 9/1913 Conkling ..... 405/249
2,128,428 A * 8/1938 Murray, Jr. ..... 405/278
3,114,244 A * 12/1963 Silver ..... 405/285
3,170,201 A * 2/1965 Nofziger ..... 52/732.2
3,192,538 A * 7/1965 Tad ..... 52/169.8
3,302,412 A * 2/1967 Hunsucker ..... 405/278
3,728,837 A 4/1973 Kiefer, Jr.
3,869,868 A * 3/1975 Irsai ..... 405/285
3,938,199 A * 2/1976 Laven ..... 4/510
3,986,309 A * 10/1976 Coulter ..... 52/166
4,572,711 A * 2/1986 Benson et al. ..... 405/286

(Continued)

*Primary Examiner*—Carl D. Friedman
*Assistant Examiner*—Basil Katcheves
(74) *Attorney, Agent, or Firm*—William J. Sapone; Coleman Sudol Sapone, P.C.

(57) ABSTRACT

The invention provides a modular post system including a plurality of modular post members 10, 20 which are interconnectable to form a post structure 30. The modular post members include a plurality of front post members 10 and rear post members 20, which are generally elongate and are designed to be positioned and interconnected adjacent one another such that each of the front and rear modular post members extends in the same general direction and has a region of lap with an adjacent one of the post members. Each of the modular post members is adapted to interconnect with an adjacent post member in the lap region, each modular post member including connection means comprising a connecting element 12, 22 adapted for engagement with a complementary connecting element 22, 12 at the corresponding lap region of an adjacent post member. The engagement of the connecting elements may be by sliding insertion of a male connecting element 12 of a front post member 10 into the complementary female connecting element 22 of a rear post member in a direction substantially parallel to a longitudinal axis of the post members The invention also provides a modular wall assembly 50, which includes a plurality of modular post members 10, 20 which are inter-connectable to form a plurality of separate post structures 30 according to the modular post system of the invention; and a plurality of modular wall panels 40 attachable to the post structures and adapted to span a spacing between the separate post structures.

16 Claims, 6 Drawing Sheets

U.S. PATENT DOCUMENTS 4,884,378 A * 12/1989 Scheiwiller ..... 52/169.4
5,469,683 A * 11/1995 McKenna et al. ..... 52/730.3
5,494,261 A * 2/1996 Gandara ..... 256/24
5,930,972 A * 8/1999 Benner et al. ..... 52/653.1
6,142,453 A * 11/2000 Martin ..... 256/65.05
6,499,725 B1 * 12/2002 Meis et al. ..... 256/65.03

* cited by examiner

MODULAR POST SYSTEM AND METHOD OF CONSTRUCTION

BACKGROUND OF THE INVENTION

The present invention relates to a modular post system and to a variety of constructions, such as walls and fences, incorporating such a post. The present invention also relates to a method of construction based upon this modular post concept.

The present invention has particular application to do-it-yourself (DIY) building of fences and/or retaining walls for domestic properties and it will be convenient to hereinafter describe the invention in this exemplary context. At the same time, however, it will be appreciated that the invention is certainly not limited to such DIY domestic applications, but that the inventive concept could also have practical applications in professional construction and may also be suitable for commercial and/or industrial properties.

SUMMARY OF THE INVENTION

According to a first aspect, the present invention provides a modular post system including a plurality of modular post members which are interconnectable to form a post structure. The modular post members are generally elongate and are designed to be positioned and interconnected adjacent one another such that each of the modular post members extends in the same general direction and has a region of lap with an adjacent one of the post members. Each of the modular post members is furthermore adapted to interconnect with an adjacent modular post member in the lap region.

In a preferred embodiment of the invention, the lap region of each modular post member includes connection means for engagement with an adjacent post member. That is, a connecting element in the lap region of each member is adapted for engagement with a complementary connecting element at the corresponding lap region of an adjacent post member. Preferably, the complementary connecting elements at the corresponding lap regions of adjacent post members are adapted to matingly engage with one another. More preferably, the mating engagement of connecting elements at the corresponding lap regions is designed to be effected by sliding insertion of a male connecting element of one post member into the complementary female connecting element of another post member in a direction substantially parallel to a longitudinal axis of the post members. The connection between the modular post members is preferably a releasable connection.

In a preferred embodiment of the invention, the plurality of modular post members includes a plurality of front modular post members and a plurality of rear modular post members. The terms "front" and "rear" are used in this context to refer generally to those sides of the post structure that face outwardly and inwardly, respectively, with regard to a wall or fence that the post structure may support. It will be appreciated, however, that these designations of "front" and "rear" could be altered (eg reversed) without departing from the concept of the post system herein described.

In a preferred embodiment of the invention, the front and rear modular post members are designed to be arranged to form a modular post structure in such a way that the front members are positioned one above another, and the rear members are also positioned one above another, but with the rear members rearwardly adjacent and lapping with the front members. Therefore, each of the front members laps with at least one, and preferably two, adjacent rear members, and each of the rear members similarly laps with at least one, and preferably two, adjacent front members. Furthermore, the lapping and adjoining front and rear members are connected with one another in the lap regions.

In a preferred embodiment of the invention, therefore, each interface between ends or opposing faces of adjacent front members in the post structure is offset with respect to each interface between ends or opposing faces of adjacent rear members in the structure. That is, while the front and rear post members are predominantly of the same length, the longitudinal extent of each front member is offset with respect to the longitudinal extent of each rear member. This offset of the joints or interfaces in the longitudinal direction lends strength to the overall modular post structure. The front and rear members are preferably of the same width and are therefore substantially aligned in the lateral direction.

In a preferred embodiment of the invention, the plurality of modular post members includes at least one post member adapted for installation underground. The at least one modular post member for installation underground preferably includes a portion which extends substantially transverse to the longitudinal extent of that member. This transverse portion is preferably elongate and preferably extends substantially at right angles to the longitudinal extent of the post member (eg in a rearward direction). This transverse portion, when installed and buried below ground, lends substantial support to the modular post structure against bending moments acting in the forward or rearward directions. The transverse portion may furthermore include one or more lateral projection (for example, at a distal or free end of the transverse portion) to further assist the resistance of the modular post structure to movement once assembled. Modular post members having this transverse portion are particularly useful when the post structure is used to support a retaining wall, as will become more apparent later in the description.

According to a second aspect, the present invention provides a modular wall assembly including:

- a plurality of modular post members which are interconnectable to form a plurality of separate post structures according to the modular post system of the invention described above; and
- a plurality of modular wall panels attachable to the post structures and adapted to span a spacing between the separate post structures.

In a preferred embodiment of the invention the post structures and the wall panels include co-operating geometries which enable ready interconnection of the wall panels and the post structures. The modular post members in each separate post structure preferably combine to define attachment means for connection with an adjoining panel. Similarly, each panel preferably includes a complementary attachment means for connection with the modular post members of an adjoining post structure.

The complementary post structure and wall panel attachment means preferably take the form of matingly engagable geometries or elements. In this regard, the modular post members of the post structure preferably together define one of either a male or a female attachment element, and each wall panel includes a complementary female or male attachment element, respectively, for mating engagement therewith. In a preferred embodiment of the invention, the mating engagement of the post and panel attachment elements is designed to be effected by relative sliding movement of the panels in a direction substantially parallel to a longitudinal axis of the post structures.

In this way, a fence or wall can be easily constructed by first erecting plurality of modular post structures according to the invention described above. The post structures are spaced apart along a line of the wall or fence, with the spacing between the post structures corresponding to a width (or length) of the individual modular fence/wall panels. The modular post members of each post structure preferably together define a vertical groove along either side of the post structure, and each panel preferably has a complementary projection at either end. After or during erection of the post structures, therefore, the panels can simply be slotted into position between the post structures with the 'tongue-and-groove' type connection. The panels can similarly be removed if necessary.

In one embodiment of the invention the panels are relatively short in their vertical extent (ie parallel to the longitudinal axis of the post structures) so that several panels are required to build a complete panel span between two post structures. These panels are designed to be stacked upon one another, and they may include mating or interlocking geometry to facilitate that stacking.

According to a third aspect, therefore, the present invention provides a method of construction which includes erection of one or more modular post structures, the method including the steps of:

positioning a plurality of elongate modular post members adjacent one another such that each post member extends in the same general direction and has a region of overlap with an adjacent one of the modular post members:

wherein the step of positioning the modular post members in overlap with one another also interconnects the adjacent members in the region of overlap.

In a preferred embodiment of the invention, the positioning of the modular post members, and hence the interconnection of the members in each respective overlap region, includes movement of one post member relative to another substantially parallel to a longitudinal direction of the post structure. This relative movement preferably provides interlocking or mating engagement between connecting elements in the overlap regions of adjacent post members.

In a preferred form of the invention, the method of construction includes erection of a plurality of modular post structures and the attachment there-between of a plurality of wall panels to form a wall or fence structure.

BRIEF DESCRIPTION OF THE DRAWINGS

For assistance in arriving at a more complete understanding of the present invention, preferred embodiments of a modular post assembly, and a modular wall construction according to this invention are hereafter described with reference to the accompanying drawings, in which like reference characters designate like features, and in which.

DETAILED DESCRIPTION OF THE PREFERRED EMBODIMENTS

Figure 1:
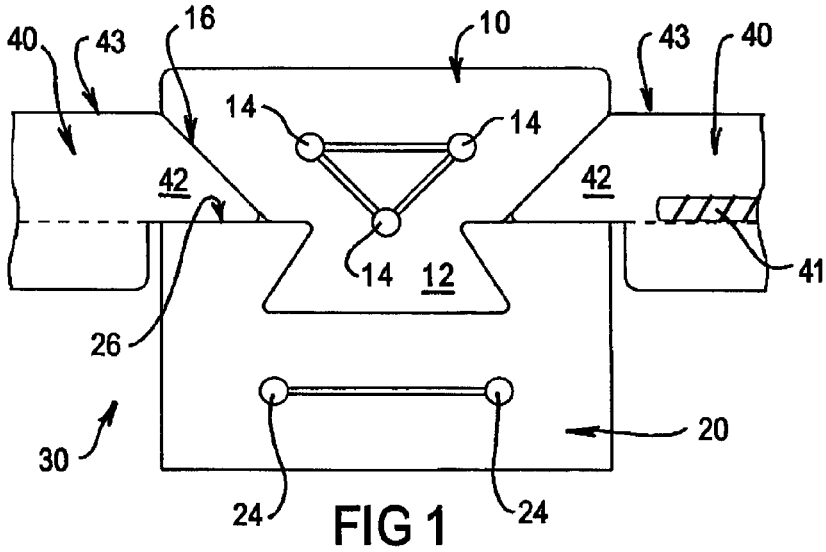
FIG. 1 is a plan view of a modular post system according to a preferred embodiment of the present invention with wall panels attached.
Figure 2:
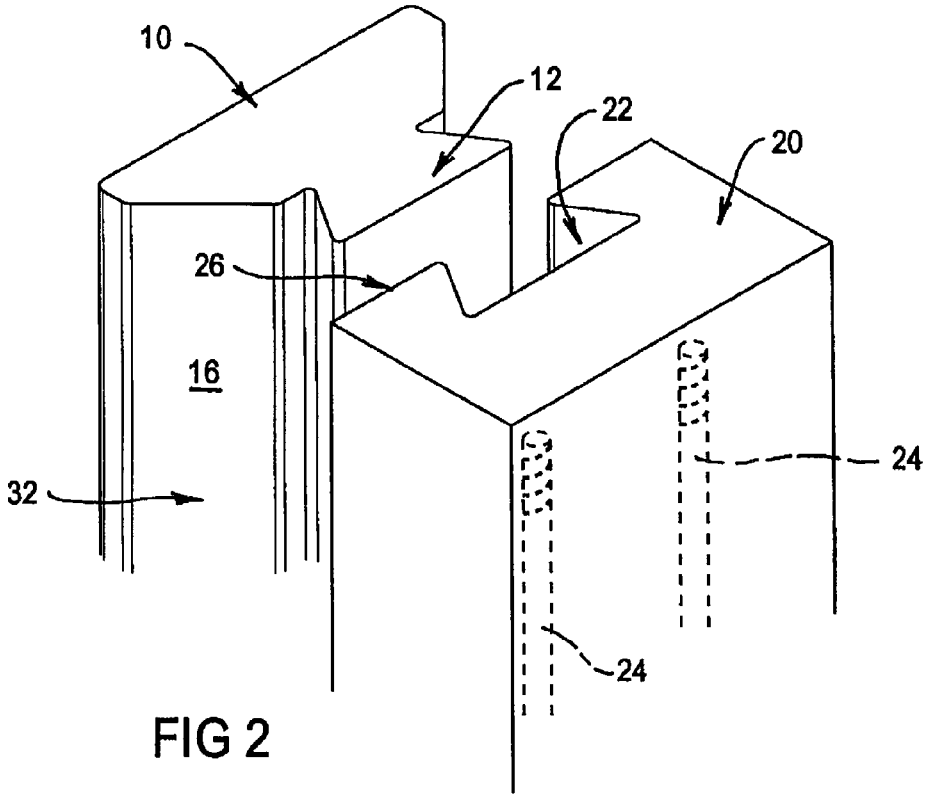
FIG. 2 is a perspective view of front and rear modular post members for the post system according to the embodiment shown in FIG. 1.
Figure 3:
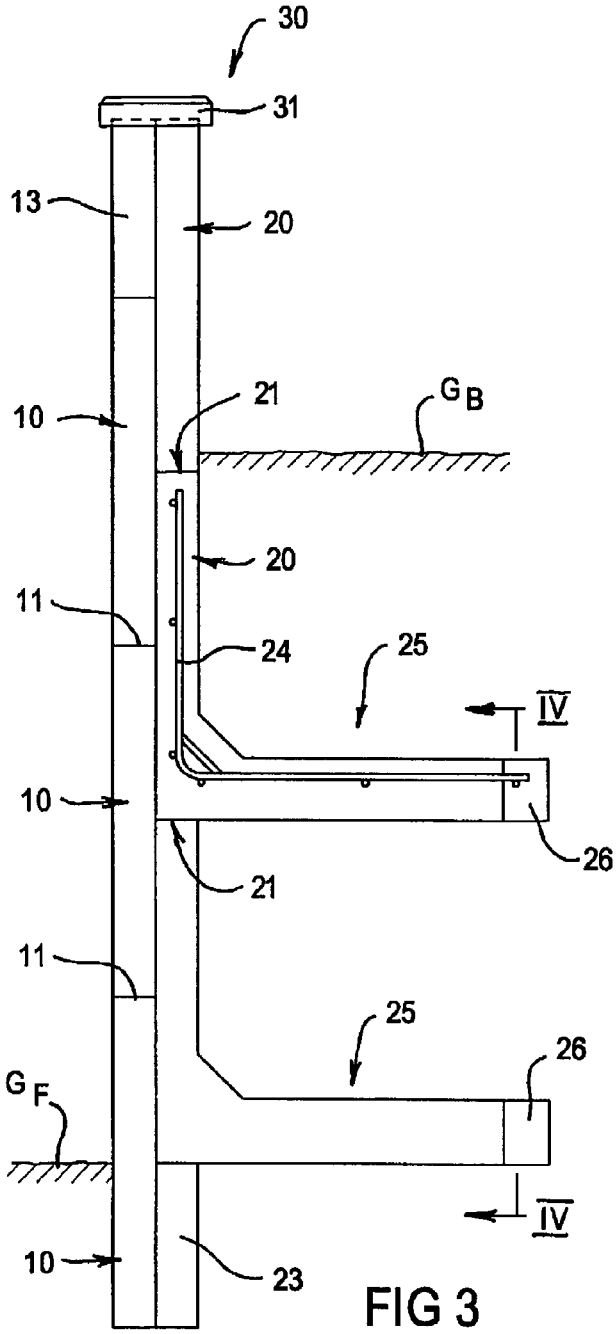
FIG. 3 is a schematic side view of a post structure according to a preferred embodiment of the modular post system of the invention installed or erected for a retaining wall structure.

Referring firstly to FIGS. 1 to 3 of the drawings, the present invention provides a modular post assembly which includes a plurality of elongate modular front and rear post members 10, 20 which are inter-connectable to form a post structure 30. As is clear from FIG. 3, the front members 10 are positioned in series, one above another, at a front or outward facing side of the post structure 30, and the rear members 20 are also positioned in series, one above another, at a rear or inwardly facing side of the post structure.

This particular example of the modular post system of the invention is furthermore such that each front modular post member 10 laps with two adjacent rear post members 20 and is adapted to interconnect with those adjacent rear members in the lap regions. Similarly, each rear modular post member 20 laps with two adjacent front post members 10 and is adapted to interconnect with those adjacent front members in the lap regions. Accordingly, an interface 11 between ends or opposing faces of adjacent front members 10 in the post structure is longitudinally offset with respect to an interface 21 between ends or opposing faces of adjacent rear members 20 in the structure. That is, the longitudinal extent of each front member 10 is offset with respect to the longitudinal extent of each rear member 20. This offset of the joints or interfaces 11, 21 lends strength to the overall post structure 30. It is apparent from FIG. 1 that the front and rear members 10, 20 have substantially the same width, so they are therefore substantially aligned in the lateral direction.

As shown in FIGS. 1 and 2, the front and rear members 10, 20 are adapted to interconnect with each other in the lap regions via a mating connection of male and female connecting elements 12, 22. These connecting elements 12, 22 are designed to interlockingly engage one another by relative sliding movement parallel to the longitudinal extent of the members and the post. That is, the male connecting element 12 in the form of a trapezoidal projection at a rear side of the front member 10 is adapted to be inserted into and engage with a complementary trapezoidal slot 22, which slot constitutes the female connecting element at the front side of the rear modular post member 20. This design of the connecting elements provides for quick and easy sliding assembly of the post structure 30 and also readily enables any disassembly of the post members that may become necessary.

In order that the front and rear modular post members 10, 20 lap consistently with one another, the modular post assembly includes a first or 'starter' post member (in this case, a rear member 23) which is approximately half the length of the other standard post members 10, 20. This 'starter' member 23 laps substantially over its entire length with the adjacent front post member 10. Similarly, in order that the modular post structure ends neatly at the top, a final or 'finisher' post member (in this case, a front member 13) is employed. Again, it's approximately half the length of the standard front and rear post members 10, 20 and laps substantially over its entire length with the adjacent rear post member 20. The standard front and rear modular post members 10, 20 all preferably have the same length—in this case, about 800 mm.

The modular post members 10, 20 are preferably cast from concrete and are reinforced with steel bars or rods 14, 24. As shown in FIG. 1, the reinforcement bars 14 in the front members 10 are arranged in a triangular configuration, while a pair of reinforcement bars 24 extend the length of the rear members 20 in parallel. The post members could alternatively be formed from a range of different materials, including timber, steel, polymer/plastic and composite materials. The service requirements of the post structures will usually dictate the material. For use in a retaining wall structure as in the present example, the strength and durability of reinforced concrete is desirable.

When a post structure 30 according to this invention is erected for a retaining wall as shown in FIG. 3, the post structure (and wall) will have soil or earth piled behind it to a substantially elevated level $G_B$ relative to a ground level $G_F$ in front of it. A hole is initially prepared below the front ground level $G_F$ to receive and support an end of the post structure comprising the first front member 10 and the 'starter' rear member 23. The first of the rear members 20 is then located or installed from about the front ground level $G_F$ to be subsequently buried with back-filled soil. Importantly, the rear modular post members 20 to be installed below the elevated ground level $G_B$ are specifically designed for this role and include an integrally cast transverse portion 25 which extends in the rearward direction substantially at right angles to the overall length of the post structure 30. When the rear post members 20 are buried by back filling behind the post structure 30 (and the wall), the buried transverse portions 25 provide substantial resistance to any undesirable movement of the structure from bending moments which may act on the post in the forward or rearward directions. These transverse portions 25 also desirably include one or more lateral projection or toe 26 at their free ends to further resist forward or rearward movement of the post structure. These cantilevered transverse portions 25 are also typically reinforced with steel rods 24.

Figure 5A:
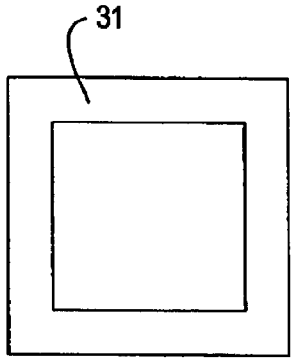
FIGS. 5*a* and 5*b* are bottom and side views, respectively, of a cap member for the top of the post structure shown in FIG. 3.
Figure 5B:
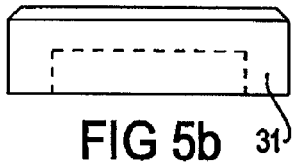
Figure 4:
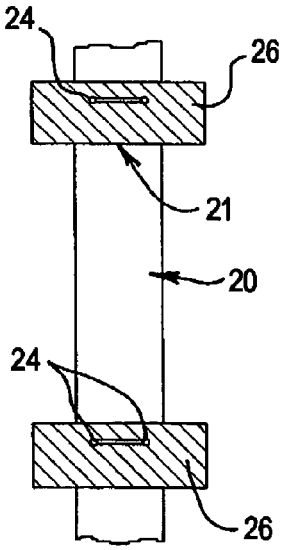
FIG. 4 is sectioned view in the direction of arrows IV—IV in FIG. 3.

With brief reference to FIGS. 5*a* and 5*b*, each post structure 30 includes a cap member 31 to crown or cover the upper ends of the assembled modular post members.

Figure 6:
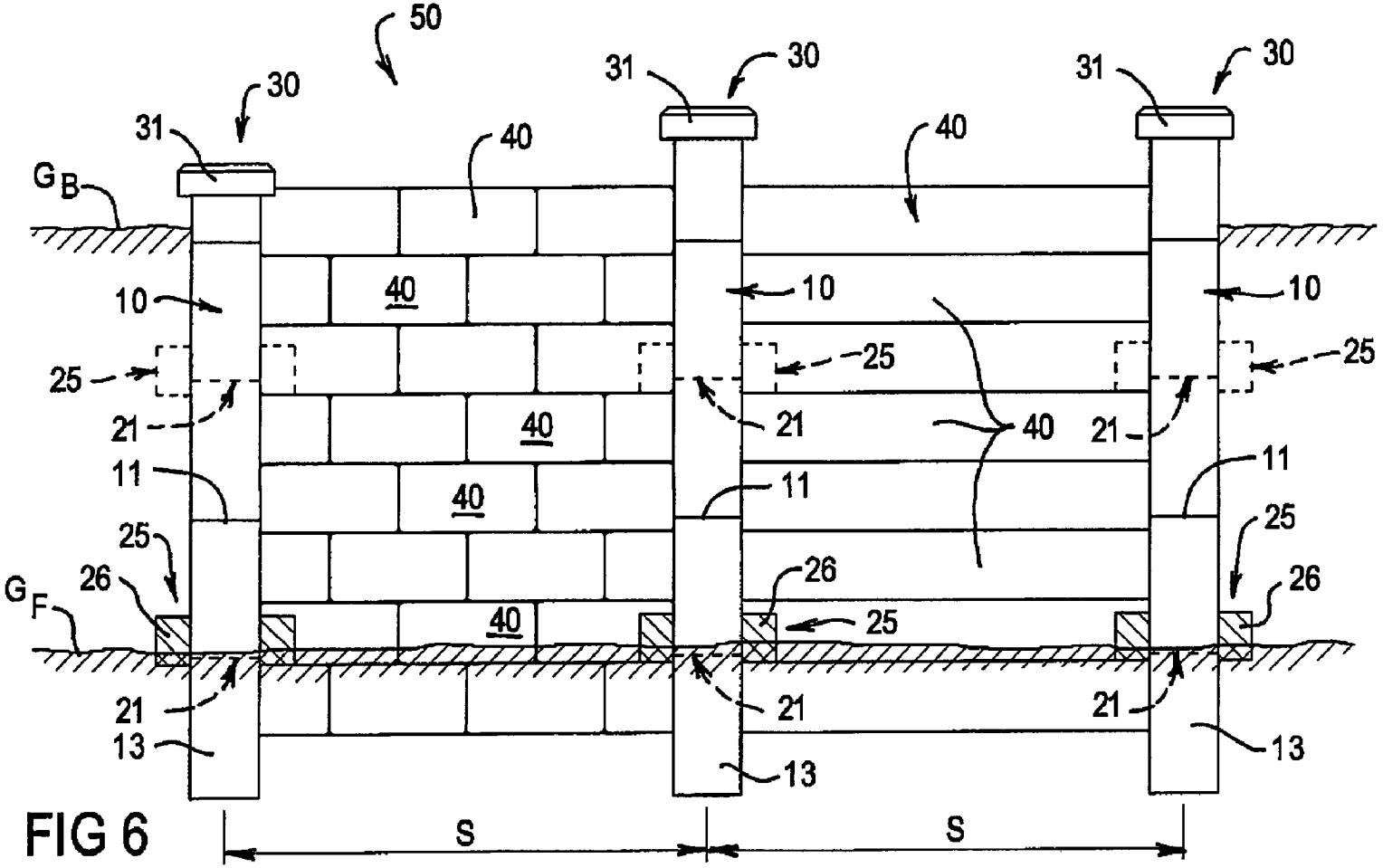
FIG. 6 is a front view of a modular wall structure according to a preferred embodiment of the present invention.

Referring now to FIGS. 1 and 6 of the drawings, a number of post structures 30 are combined with wall panels 40 to form a retaining wall or fence structure 50. The front and rear post members 10, 20 of each post structure have specific geometries in the form of surfaces 16, 26 which combine to define slots or grooves 32 that run the length of both lateral sides of the post structure 30. The wall panels 40, which, like the post members, are cast from concrete and are reinforced with steel rods 41, have a wedged shaped configuration 42 at opposite side edges thereof to complement and cooperate with the geometry of the slots 32. That is, the wedge-shaped elements 42 at the edges of the panels 40, and the complementary slots or grooves 32 at the lateral sides of the posts form male and female elements, respectively, for attaching or securing the wall panels 40 between the post structures.

The post structures 30 are erected at a spacing S to match the length or breadth of the wall panels 40 so that a panel will neatly span that spacing between posts. The panels 40 are then positioned between the posts by inserting the wedge-shaped elements 42 into the slots 32 in a direction parallel to the length of the post structures. The panels 40 are preferably inserted as the post structure itself is being erected, so that excessive lifting of the wall panels is not required and so that the soil or earth can be back-filled against the post structures and wall (50) as the construction process proceeds.

In this example, the panels 40 are relatively short in their vertical extent so that several panels are required on top of one another to build a complete panel span between two post structures. These panels 40 are therefore designed to be stacked on top of one another, and may also include mating or nesting geometries on their upper and lower surfaces to facilitate that stacking. The panels may also include some form of decoration on a front surface 43 to present a pleasing appearance, such as embossing to look like a row of blocks.

Figure 7:
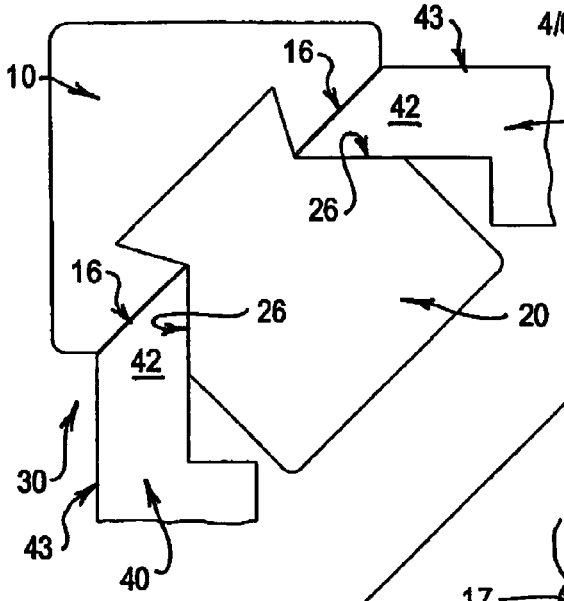
FIG. 7 is a plan view of a corner post structure with wall panels attached for a modular wall assembly according to a preferred embodiment of the present invention.

FIG. 7 illustrates the configuration of front and rear modular post members 10, 20 for a corner post 30 of a wall or fence structure incorporating a corner. The fundamental features of this corner post structure 30 are unchanged compared with the post structure shown in FIG. 1. One obvious difference, of course, is that the modular post member surfaces 16, 26 defining the attachment slots or grooves 32 for the wall panels 40 are differently oriented. This, combined with a slightly different configuration of the wedge-shaped attachment elements 42 at the side edges of the panels 40, enables the wall panels 40 to connect with laterally opposite sides of the corner post 30 at a 90° angle. Another very notable difference is that the male and female connecting elements are reversed for the front and rear post members in the corner post structure. In other words, the rear post member's connecting element 22 is formed as the male trapezoidal projection, while the connecting element 12 of the front member is formed as the complementary female trapezoidal slot.

Figure 8:
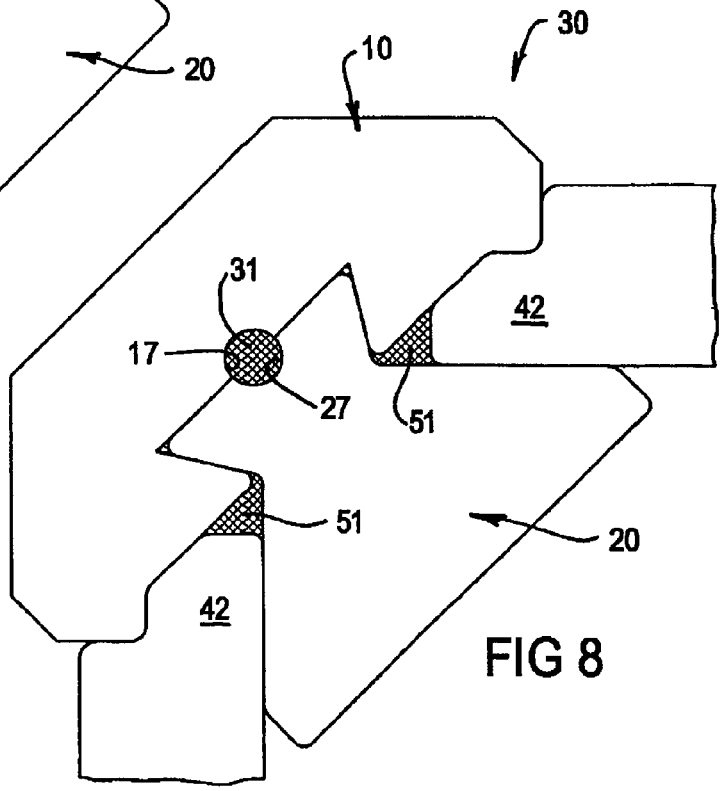
FIG. 8 is a plan view of a corner post structure with wall panels attached for a modular wall assembly according to another preferred embodiment of the present invention.

FIG. 8 of the drawings illustrates an alternative configuration for a corner post structure 30 and its associated wall panels 40 according to this invention. In this embodiment, the front and rear modular post members 10, 20 and the wall panels 40 have numerous edges that are rounded, particularly in the regions where the post members and/or wall panels come into contact with one another. These rounded edges reduce the risk of chipping and/or cracking in those regions. Each of the front and rear post members 10, 20 of this embodiment also include complementary semi-cylindrical recesses 17, 27 which align with one another to form a cylindrical cavity 31 extending longitudinally of the post structure. This cylindrical cavity 31 is designed to be filled with grout once the post structure is assembled to eliminate subsequent movement between the individual post members. Similarly, spaces 51 between the ends of the wedge-shaped elements 42 and the complementary slots or grooves 32 in the post member 30 are also typically filled with grout after insertion of the wall panels to prevent subsequent movement therebetween.

Figure 9:
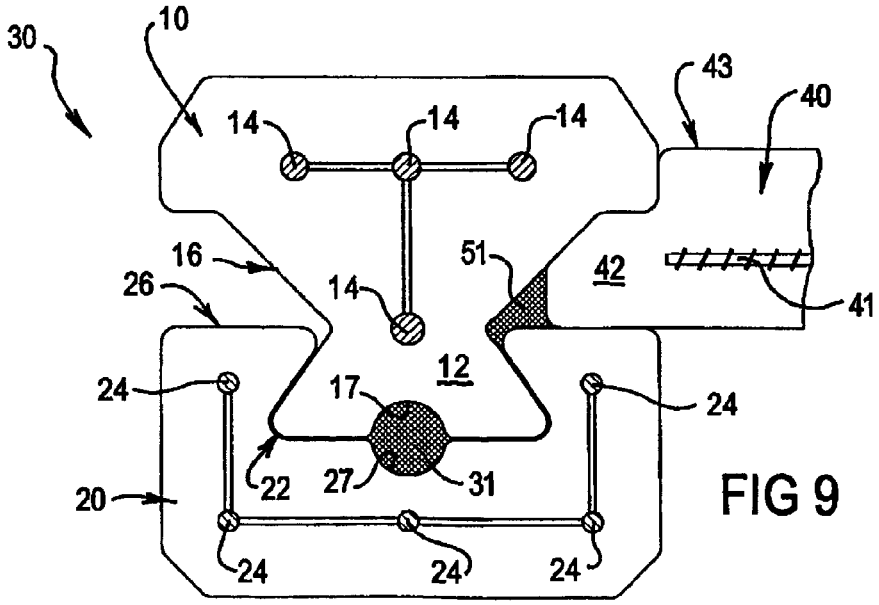
FIG. 9 is a plan view of a modular post system according to another preferred embodiment of the present invention with wall panels attached.

FIG. 9 of the drawings similarly illustrates an alternative configuration to the post structure 30 shown in FIG. 1. As with the embodiment in FIG. 8, many of the edges of the front and rear modular post members 10, 20 and the wall panels 40 are rounded to reduce the risk of chipping and/or cracking. The arrangement of the steel reinforcement bars or rods 14, 24 in each of the front and rear post members 10, 20 respectively, is also somewhat different from the arrangement shown in FIG. 1. Furthermore, this embodiment also includes the grouting 31, 51 to eliminate movement between the various components of the retaining wall structure after assembly. The grout material is typically forced under pressure from the top of each post structure 30 into the cavities 31,51 as shown.

Figure 10:
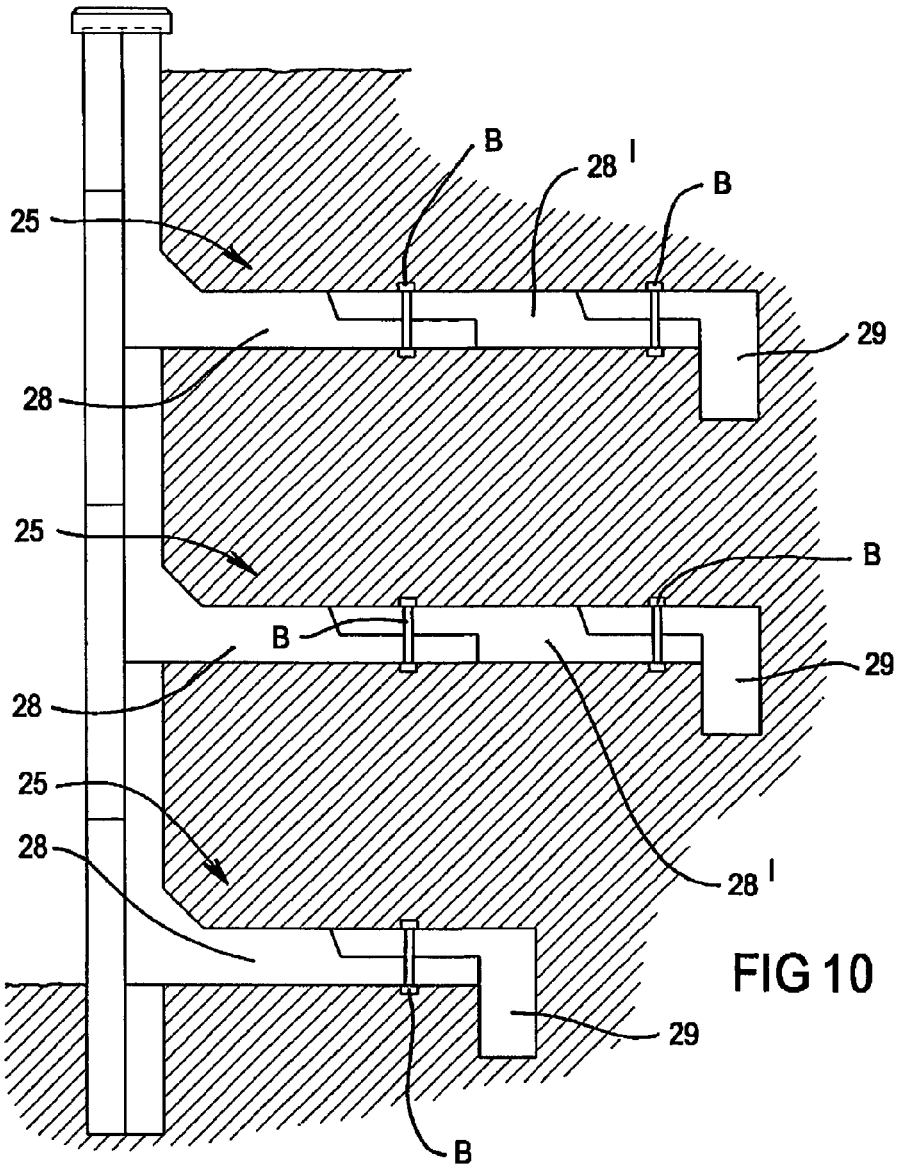
FIG. 10 is a schematic side view of a modular post structure according to a further embodiment of the modular post system of the invention installed or erected for a retaining wall structure.
Figure 12A:
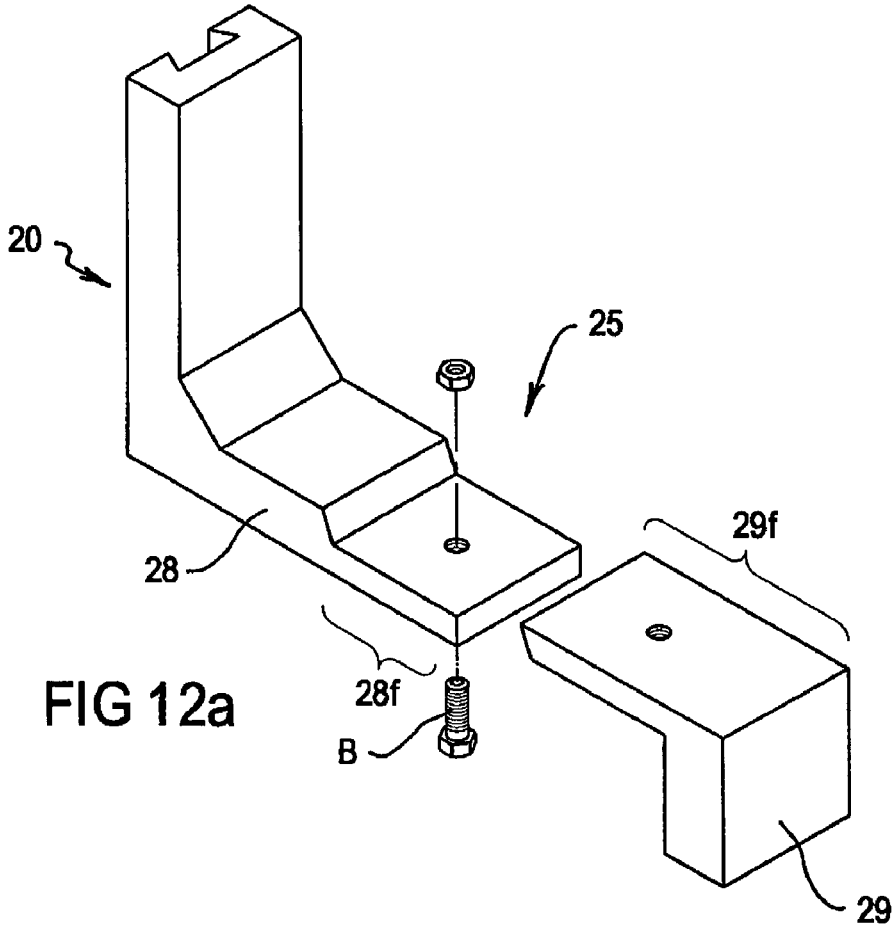
FIGS. 12*a* and 12*b* are detailed views, respectively, of stabilizing projections of a modular post system according to embodiments of the invention.
Figure 12B:
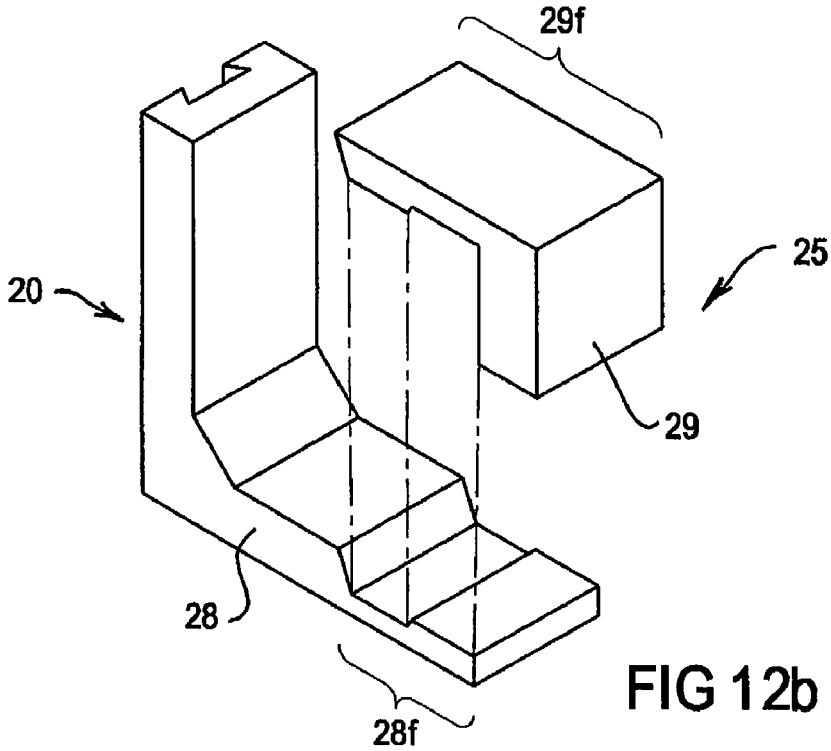

FIG. 10 is a schematic side view of a post structure 30 erected for a retaining wall structure similar to that shown in FIG. 3. In this embodiment, however, the transverse portion 25 of each of the rear post members 20 is an assembly of multiple components. In particular, the transverse portion 25 includes a first rearward extension element 28, which is formed integrally with the vertical part of the rear post member 20. A separate toe element 29 having a downwardly projecting toe 26 at the end thereof is secured to the first extension element 28 by a bolt B which is inserted and fastened through the lapped flanges 28*f* and 29*f* thereof, as shown in FIG. 12*a*. As an alternative, the lapping flanges 28*f* and 29*f* of the first rearward extension 28 and the toe element 29 may simply be formed with integral inter-engaging geometries, as shown in FIG. 12*b*. As is clearly visible from FIG. 10, the transverse portion 25 may also include an intermediate extension element 28' secured between the first extension element 28 and the toe element 29.

Figure 11A:
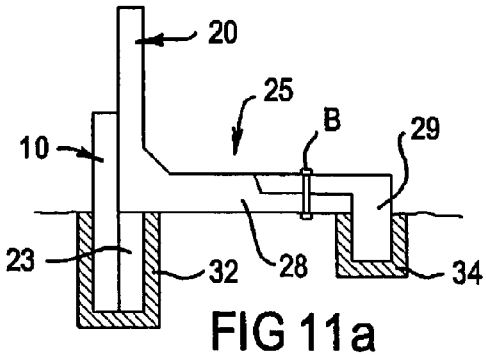
FIGS. 11*a* and 11*b* are detailed views, respectively, of foundations for a post structure according to embodiments of the invention.
Figure 11B:
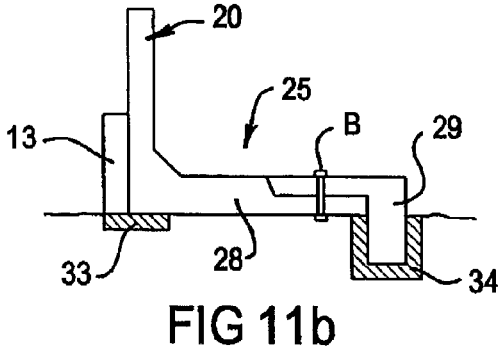

With reference now to FIGS. 11*a* and 11*b*, the post structure 30 of the present invention preferably includes a foundation member for location at the base of the post structure 30. The foundation members provide a stable base upon which each post structure can be erected, and also assist by marking the positions at which the post structures are to be erected. In one embodiment, as shown in FIG. 11*a*, the foundation member takes the form of a post socket 32 recessed into the ground for receiving the lowermost modular post members 10, 23 therein. Alternatively, as shown in FIG. 11*b*, the foundation member may be in the form of a base plate 33 upon which the lowermost modular post members 13, 20 are designed to seat.

As is also clear from FIGS. 11*a* and 11*b*, the foundation of the post structure 30 may include a toe socket 34 for receiving the downwardly projecting toe of the lowermost toe element 29.

Finally, it will be appreciated that various alterations and/or additions may be introduced into the particular construction and arrangement of the parts specifically herein described without departing from the spirit or ambit of the present invention.

I claim:

1. A modular post system including a plurality of modular post members which are inter-connectable to form a post structure, the modular post members being generally elongate and designed to be positioned and interconnected adjacent one another such that each of the modular post members extends in the same general direction and laps with an adjacent one of the post members to form a lap region, the longitudinal extent of each modular post member being offset with respect to the longitudinal extent of an adjacent one of the post members, wherein each of the modular post members is adapted to interconnect with an adjacent modular post member in the lap region, wherein the plurality of modular post members includes a plurality of front modular post members and a plurality of rear modular post members, the front and rear modular post members being designed to be arranged to form a modular post structure in such a way that the front members are positioned one above another, the rear members are also positioned one above another, with the rear members being rearwardly adjacent to and lapping with the front members, wherein the longitudinal extent of each front member is offset with respect to the longitudinal extent of each rear member, such that an interface between ends or opposing faces of adjacent front members in the post structure is offset with respect to an interface between ends or opposing faces of adjacent front members in the post structure is offset with respect to an interface between ends or opposing faces of adjacent rear members in the structure.

2. The modular post system according to claim 1, wherein the plurality of modular post members includes at least one post member adapted for installation underground, the at least one modular post member for installation underground including a portion which extends substantially transverse to the longitudinal extent of that member.

3. The modular post system according to claim 2, wherein said transverse portion is elongate and extends substantially at right angles to the longitudinal extent of the post member.

4. The modular post system according to claim 3, wherein the transverse portion further includes one or more lateral projection.

5. The modular post system according to claim 1, wherein each of the front members is adapted to lap with at least one, and preferably two, adjacent rear members, and each of the rear members is similarly adapted to lap with at least one, and preferably two, adjacent front members, the lapping and adjoining front and rear members being connected with one another in the lap regions.

6. A modular wall assembly including:

a plurality of modular post members which are interconnectable to form a plurality of separate post structures according to the modular post system as claimed in claim 1; and a plurality of modular wall panels attachable to the post structures and adapted to span a spacing between the separate post structures.

7. The modular wall assembly according to claim 6, wherein the post structures and the wall panels include co-operating geometries that enable ready interconnection of the wall panels and the post structures.

8. The modular wall assembly according to claim 7, wherein the modular post members in each separate post structure combine to define attachment means for connection with an adjoining panel, and each panel includes a complementary attachment means for connection with the modular post members of an adjoining post structure.

9. The modular wall assembly according to claim 8, wherein the complementary post structure and wall panel attachment means take the form of matingly engagable geometries or elements, such that the modular post members of the post structure together define one of either a male or a female attachment element for mating engagement therewith.

10. The modular wall assembly according to claim 9, wherein the mating engagement of the post and panel attachment elements is adapted to be effected by relative sliding movement of the panels in a direction substantially parallel to the longitudinal axis of the post structures.

11. The modular wall assembly according to claim 10, wherein the modular post members of each post structure together define a vertical groove along either side of the post structure, and each panel has a complementary projection at either end thereof.

12. The modular wall assembly according to claim 11, wherein the panels are relatively short in theft vertical extend (i.e. parallel to the longitudinal axis of the post structures) so that several panels are required to be stacked on top of one another to build a complete panel span between two post structures.

13. The modular wall assembly according to claim 12, wherein upper and lower surfaces of the panels have interlocking geometry to facilitate stacking.

14. A method of construction which includes erection of one or more modular post structures, the method including the steps of:

providing a modular past system including a plurality of nodular post members which are inter-connectable to form a post structure, the modular post members being generally elongate and designed to be positioned and interconnected adjacent one another such that each of the modular post members extends in the same general direction and laps with an adjacent one of the post members, such that the longitudinal extent of each modular post member is offset with respect to the longitudinal extent of an adjacent one of the post members wherein each of the modular post members, is adapted to matingly interconnect with an adjacent modular post member through complementary male and female connecting elements provided in the lap region of respective post members;

interconnecting the front and rear post members together by slidingly inserting a male connecting element of one post member into a complimentary female connecting member of another post member in a direction substantially parallel to a longitudinal axis of the post member positioning the front members one above another, and positioning the rear members one above another, the rear members being rearwardly adjacent to and lapping with the front members, offsetting the longitudinal extent of each front member with respect to the longitudinal extent of each rear member, offsetting an interface between ends or opposing faces of adjacent front members in the post structure with respect to an interface between ends or opposing faces of adjacent front members in the post structure and with respect to an interface between ends or opposing faces of adjacent rear members in the structure.

15. The method of construction according to claim 14, including erection of a plurality of modular post structures and the attachment there-between of a plurality of wall panels to form a wall or fence structure.

16. A modular post system for constructing an earth retaining wall comprising a plurality of modular post members which are inter-connectable to form a post structure, the modular post members being generally elongate and designed to be positioned and interconnected adjacent one another such that each of the modular post members extends in the same general direction and laps wit an adjacent one of the post members, and such that the longitudinal extent of each modular post member is offset with respect to the longitudinal extent of an adjacent one of the post members, wherein each of the modular past members is adapted to interconnect with an adjacent modular post member in the lap region, wherein the plurality of modular nest members includes a plurality of front modular post members and a plurality of rear modular post members, the front and rear modular post members being designed to be arranged to form a modular post structure in such a way that the front members are positioned one above another, the rear members are also positioned one above another, with the rear members being rearwardly adjacent to and lapping with the front members, and in such a way that the longitudinal extent of each front member is offset with respect to the longitudinal extent of each rear member, such that an interface between ends or opposing faces of adjacent front members in the post structure is offset with respect to an interface between ends or opposing faces of adjacent front members in the post structure is offset with respect to an interface between ends or opposing faces of adjacent rear members in the structure and wherein the plurality of post members includes at least one post member adapted for installation underground, at least one post member including an elongate portion which extends substantially transverse to the longitudinal extent of tat member, in a rearward direction relative to said retaining wall for burial within the earth which the retaining wall retains, for resisting movement of the retaining wall.

* * * * *